US005604340A

United States Patent [19]

Yamada et al.

[11] Patent Number: 5,604,340

[45] Date of Patent: Feb. 18, 1997

[54] GAS INSULATED SWITCHGEAR INSERTION RESISTOR AND MAIN CONTACTS OPERATING MECHANISM HAVING TIME DELAY FEATURE

[75] Inventors: Hitoshi Yamada; Masatomo Ohno; Manabu Takamoto; Hideo Kawamoto, all of Hitachi, Japan

[73] Assignee: Hitachi, Ltd., Tokyo, Japan

[21] Appl. No.: 438,731

[22] Filed: May 10, 1995

[30] Foreign Application Priority Data

May 23, 1994 [JP] Japan ..... 6-108086

[51] Int. Cl.[6] ..... H01H 9/42; H01H 33/16

[52] U.S. Cl. ..... 218/143; 218/84; 218/154; 218/78

[58] Field of Search ..... 218/144, 143, 218/145, 43–88, 153, 154

[56] References Cited

U.S. PATENT DOCUMENTS

| | | | |
|---|---|---|---|
| 3,659,065 | 4/1972 | Roidt et al. | 218/84 |
| 4,513,187 | 4/1985 | Schaad et al. | 218/143 |
| 4,538,039 | 8/1985 | Gotoh et al. | 218/143 X |
| 4,636,599 | 1/1987 | Bischofberger et al. | 218/143 |
| 5,170,023 | 12/1992 | Pham et al. | 218/143 |
| 5,206,470 | 4/1993 | Hokutou et al. | 218/84 X |
| 5,243,160 | 9/1993 | Ohno et al. | 218/84 |
| 5,424,504 | 6/1995 | Tanaka et al. | 218/78 |
| 5,451,731 | 9/1995 | Yoshizumi et al. | 218/143 |

FOREIGN PATENT DOCUMENTS

| | | | |
|---|---|---|---|
| 2-22487 | 5/1990 | Japan | H01H 33/16 |
| 2-50574 | 11/1990 | Japan | H01H 33/70 |

*Primary Examiner*—J. R. Scott

*Attorney, Agent, or Firm*—Fay, Sharpe, Beall, Fagan, Minnich & McKee

[57] ABSTRACT

A gas circuit breaker having a resistance circuit breaking portion connected in parallel with a main circuit breaking portion includes a main circuit breaking portion actuating mechanism and a resistance circuit breaking portion actuating mechanism. The resistance circuit breaking portion actuating mechanism is provided with a first delaying mechanism mechanically coupled to the main circuit breaking portion actuating mechanism, and a second delaying mechanism, independent from the first delaying mechanism, which is operated by an electrical command signal relating to either a making or an interrupting electrical signal to the main circuit breaking portion actuating mechanism. The otherwise possible thermal break-down of a resistor connected in series with the resistance circuit breaking portion is prevented.

5 Claims, 5 Drawing Sheets

FIG. 4A
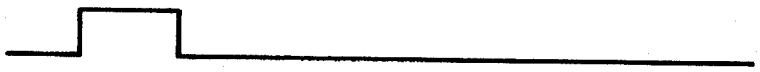
FIG. 4B
FIG. 4C
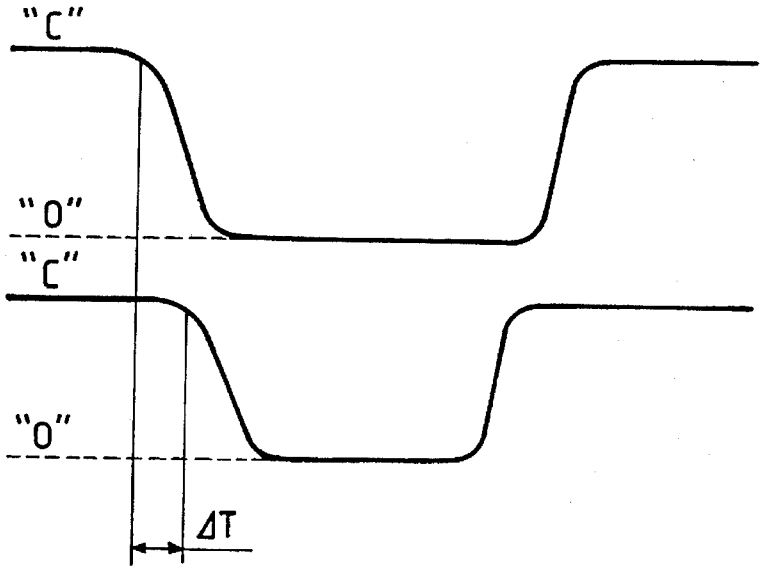
FIG. 5
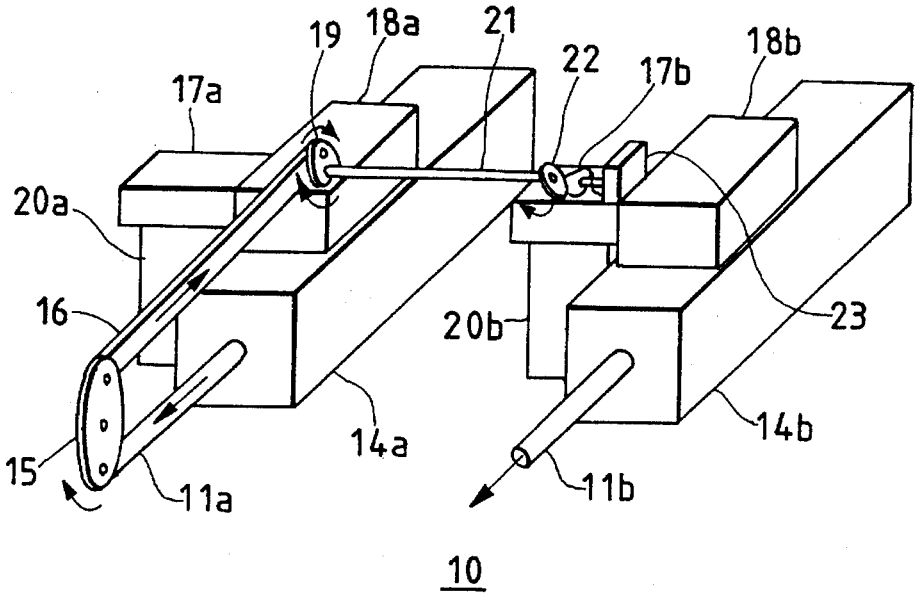

18b

GAS INSULATED SWITCHGEAR INSERTION RESISTOR AND MAIN CONTACTS OPERATING MECHANISM HAVING TIME DELAY FEATURE

BACKGROUND OF THE INVENTION

1. Field of the Invention

The present invention relates to a gas insulated switch gear device and, in particular, relates to a delay mechanism in an actuating device for a gas insulated switch gear device which performs a delay operation delayed by a predetermined time difference.

2. Conventional Art

A circuit breaker using an insulating gas (hereinafter called a gas circuit breaker) is generally constituted by a plurality of circuit breaking contacts inserted in series in a main circuit to thereby interrupt a current flowing through the main circuit. Currently, a plan of power transmission lines having a line voltage of 1000 kV has been materialized, and in view of such structural limitations as earthquake resistance and cost reduction, the height of power transmission line towers is reduced as much as possible. Accordingly, it is required to suppress an overvoltage level generated during current interruption by a circuit breaker. For this purpose, a so-called resistance circuit breaking system has being employed in which a resistor body is inserted in the main circuit after interruption of a main circuit breaking portion, and the current transferred to the resistor body is then interrupted by the resistance circuit breaking portion connected in series with the resistor body.

For realizing such a system, it is necessary for the resistance circuit breaking portion to be opened after opening of the main circuit breaking portion with a predetermined time difference. Many mechanisms for achieving such an opening time difference have been proposed. JP-B-2-50574(1990) and JP-B-2-22487(1990) disclose an example of such mechanisms wherein a coil spring is used as a driving source and the delay time is obtained from the time required for tensioning the spring and the delay of the spring operation time due to the inertia. In the instant example, the coil spring serving as the driving source for the resistance circuit breaking portion is disposed at a high voltage portion in a gas container; therefore, for an ordinary periodic inspection it has been necessary to recover and recharge gas in the container, which requires a long time. Further, constant monitoring of the driving source is difficult.

In order to improve such maintenance difficulties, a gas circuit breaker is proposed in which an actuating device for the main circuit breaking portion and for the resistance circuit breaking portion is disposed at a grounding potential portion. The gas circuit breaker is provided with a control mechanism such as a pilot valve which controls transmission of drive energy to an actuating piston, a first drive source for driving the main circuit breaking portion, a second drive source for driving the resistance circuit breaking portion which is designed to operate successive to the operation of the main circuit breaking portion, and a mechanical delay operation mechanism which actuates a pilot valve mechanism for the second drive source via an auxiliary link mechanism coupled to the actuating piston. However, with the mechanism which actuates the pilot valve for the resistance circuit breaking portion by the mechanical delay operation mechanism alone, when the operation of the delay operation mechanism malfunctions during tripping and the subsequent making operation of the gas circuit breaker, a required normal operation may not be obtained. Further, break-down or wear of the mechanical delay operation mechanism may cause the reliability of the expected operation to decrease.

SUMMARY OF THE INVENTION

An object of the present invention is to provide a gas insulated switch gear device including a gas circuit breaker provided with a first drive source for driving a main circuit breaking portion, a second drive source for diving a resistance circuit breaking portion which is designed to operate successive to the operation of the main circuit breaking portion, and a mechanical delay operation mechanism which actuates a pilot valve mechanism for the second drive source via an auxiliary link mechanism coupled to an actuating piston for the first drive source. The resistance circuit breaking portion operates within an allowable time even when break-down or wear of the mechanical delay operation mechanism is caused, and further even when, during the making operation of the gas insulated switch gear device, the main circuit breaking portion fails to perform the making operation and only the resistance circuit breaking portion completes the making operation. Such a failure may occur, for example, because of a malfunction of a main circuit breaking portion actuating system. No energy exceeding an allowable value is injected into a resistor body in the resistance circuit breaking portion.

The above object of the present invention is achieved by a gas insulated switch gear device with a resistance contact which comprises a main contact, a series connection of a resistor body and the resistance contact connected in parallel with the main contact, a stationary electrode and a movable electrode which is permitted to engage with and to disengage from the stationary electrode which are provided for the respective main and resistance contacts, and an actuating mechanism including a rod and link mechanism disposed at each of the movable electrode sides for slidably moving the same, a piston coupled to the link mechanism, a cylinder which accommodates the piston and to which a pressure medium for causing slidable movement of the piston flows in or flows out, and a control mechanism which controls the flow-in and flow-out of the pressure medium into the cylinder. The actuating mechanism is further provided with a delay means which delays the operating time of the resistance contact from the operating time of the main contact, and the delay means includes both a mechanical delaying portion and an electrical delaying portion.

According to the present invention, with the provision of the delay operation mechanism actuated by an electrical signal command, the mechanical delay mechanism is actuated in an overlapped relation with the operation of the electrical delay mechanism, the tripping operation of the resistance circuit breaking portion is reliably performed even when there is a malfunction of the mechanical delay mechanism, and dangers such as thermal break-down of the resistor body is reduced. Further, with the provision of the electrical delay operation mechanism, even when such malfunction of the making operation (wherein the main circuit breaking portion fails to complete the making operation and only the resistance circuit breaking portion succeeds the making operation) occurs, a tripping operation of the resistance contact is possible by exciting a tripping coil in a resistance circuit breaking portion use actuating device. As a result, dangers such as thermal break-down of the resistor body are reduced.

BRIEF DESCRIPTION OF THE DRAWINGS

FIGS. 4A, 4B, and 4C are time charts for explaining the delay time of open and close operations of an embodiment of the gas circuit breakers with a resistance circuit breaking portion according to the present invention;

FIG. 5 is a perspective view of an actuating mechanism of an embodiment of the gas circuit breakers with a resistance circuit breaking portion according to the present invention;

DETAILED DESCRIPTION OF THE PREFERRED EMBODIMENT

Figure 1:
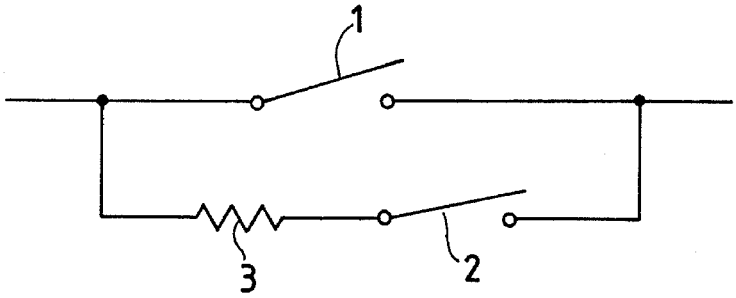
FIG. 1 is a circuit diagram of a circuit breaker with a resistance circuit breaking portion to which the present invention is applied.

Hereinbelow, the present invention is explained with reference to one embodiment as illustrated in the drawings.

FIG. 1 shows a circuit diagram of a circuit breaker, wherein a resistance circuit is connected in parallel with a main circuit. The circuit breaker circuit is constituted by a main circuit breaking portion 1 connected in a main circuit and for principally interrupting current flowing through the main circuit, and a series connection of a resistor body 3 and a resistance circuit breaking portion 2 which is connected in parallel with the main circuit breaking portion 1. In the course of a circuit breaking operation of the circuit, at first the main circuit breaking portion 1 transfers the current to be interrupted toward the circuit including the resistor body 3, the current to be interrupted is limited by the resistor body 3, and then interrupted by the resistance circuit breaking portion 2 to complete the circuit breaking operation. Because the resistor is inserted in the circuit during the circuit breaking operation, an overvoltage induced during the circuit breaking operation is suppressed. On the other hand, for the circuit making operation, the main circuit breaking portion 1 and the resistance circuit breaking portion 2 are generally made substantially at the same time. However, if it is required to suppress an overvoltage induced during the circuit making operation, the resistance circuit breaking portion 2 can be made prior to the main circuit breaking portion 1.

Figure 2:
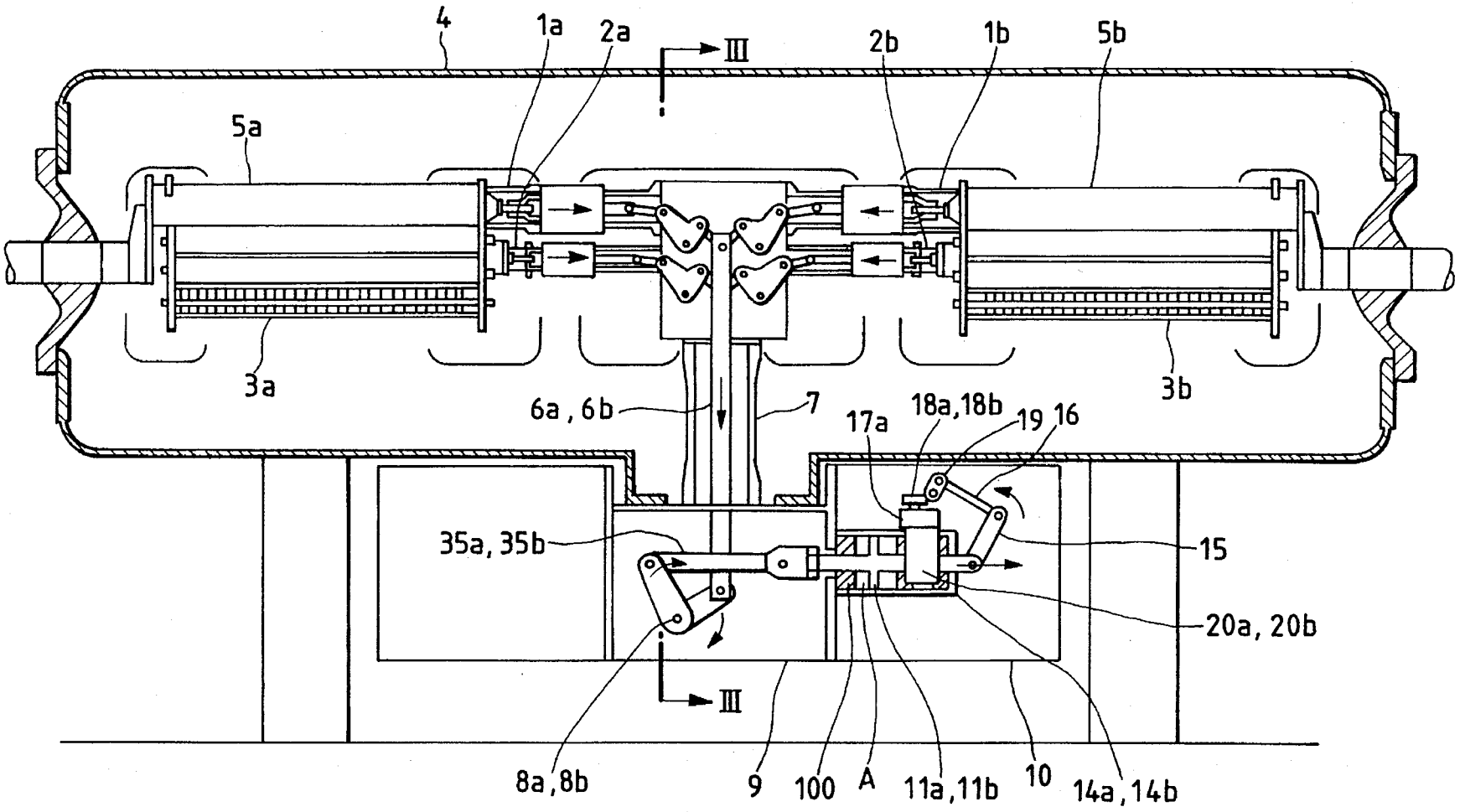
FIG. 2 is a front cross sectional view of one embodiment of the gas circuit breakers with a resistance circuit breaking portion according to the present invention.

FIG. 2 is an example of a structure resulting when the present invention is applied to the circuit of FIG. 1.

Figure 3:
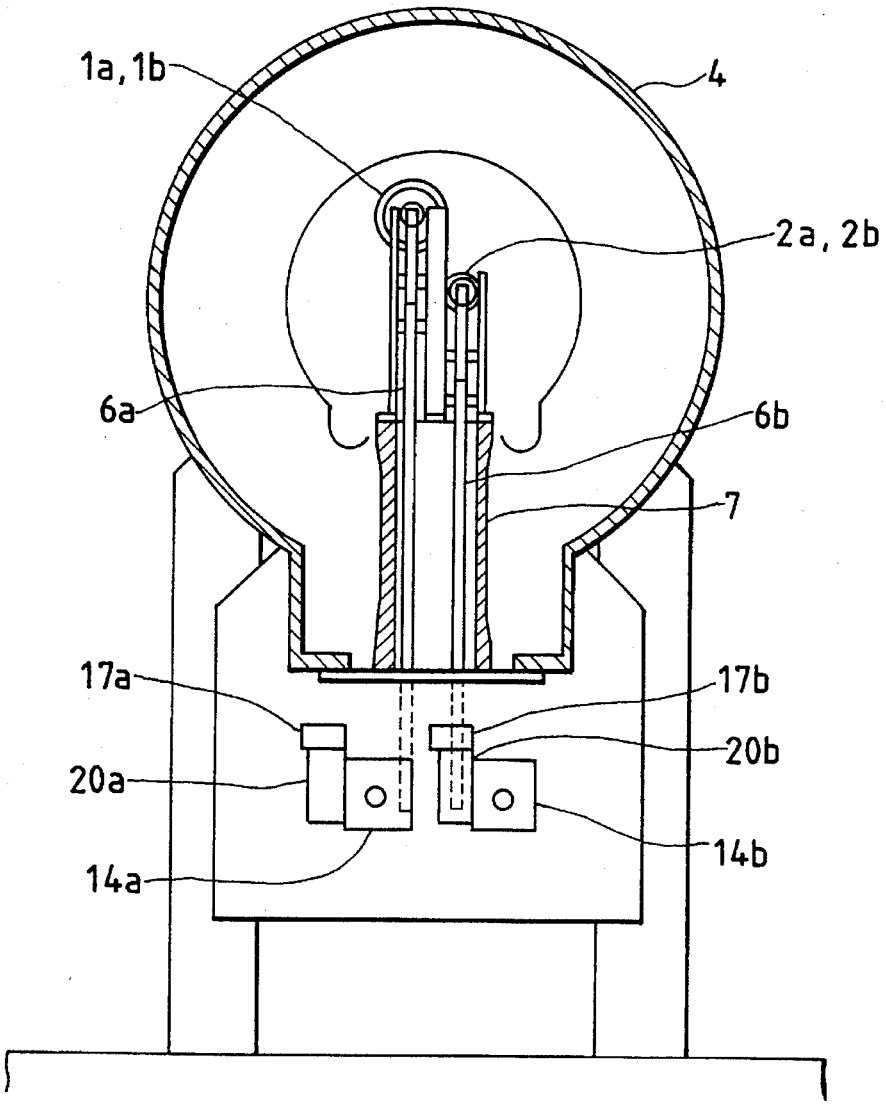
FIG. 3 is a cross sectional view taken along the line III—III in FIG. 2.

FIG. 3 is a cross sectional view taken along the line III—III in FIG. 2.

Contacts 1*a* and 1*b* for a main circuit breaking portion which is connected in series with a main circuit, contacts 2*a* and 2*b* for a resistance circuit breaking portion, and resistor bodies 3*a* and 3*b* which are connected in parallel with the main circuit in order to suppress an overvoltage induced during a current interrupting operation by the main circuit breaking portion, are insulatedly accommodated within a grounded metal container 4. Numerals 5*a* and 5*b* represent conductors connecting the contacts 1*a* and 1*b* to the main circuit. The movable portions of the respective circuit breaking portions are operatively coupled to insulation rods 6*a* and 6*b*, the bottom ends of which are operatively coupled to pistons 11*a* and 11*b* of an actuating mechanism 10 via gas tightly and rotatably supported L shaped levers 8*a* and 8*b* and driving shafts 35*a* and 35*b*. Through reciprocating movement of the pistons 11*a* and 11*b* in the axial direction, movable electrodes in the contacts 1*a*, 1*b*, 2*a* and 2*b* perform engagement and disengagement with stationary electrodes thereof to complete the making and breaking operation of the circuit breaker.

The actuating mechanism 10 causes actuating fluid from an actuating fluid reservoir (not shown) to flow into a pressure chamber A in a cylinder 100 accommodating the actuating pistons 11*a*, 11*b* of actuation and drive sources 14*a*, 14*b* for the main and resistance circuit breaking portions to perform the circuit breaking operation. The charging and discharging of the actuating fluid at this instance are controlled by pilot valves 17*a* and 17*b* and main control valves 20*a*, 20*b* of the actuation and drive sources 14*a*, 14*b* for the main and resistance circuit breaking portions. Changing of the actuating fluid for the fluid reservoir is performed via a suitable fluid compressing pump (not shown). Reference numeral 7 indicates a cylindrical insulator supporting body, 9 is a casing for the mechanisms disposed at a grounding potential location, and 18*a* and 18*b* control mechanisms for the main and resistance circuit breaking portion actuating devices 19*a*, 19*b*.

FIGS. 4A, 4B and 4C show time charts for explaining two operations of the contacts 1*a* and 1*b* for the main circuit breaking portion and the contacts 2*a* and 2*b* for the resistance circuit breaking portion. FIG. 4A shows an operation command signal for the main circuit breaking portion, FIG. 4B is a time chart illustrating contact positions of the contacts 1*a* and 1*b* for the main circuit breaking portion, and FIG. 4C is a time chart illustrating contact positions of the contacts 2*a* and 2*b* for the resistance circuit breaking portion, wherein "C" represents the making condition of the contacts and "O" represents the tripped condition of the contacts. The operating timing of the respective contacts is controlled through a delayed actuation mechanism in such a manner that at the moment when a grounding current is interrupted by the contacts 1*a* and 1*b* for the main circuit breaking portion, the resistance circuit is still closed and after a proper delay operation time $\Delta T$ the resistance circuit breaking contacts 2*a* and 2*b* are opened.

FIG. 5 shows one mechanism for obtaining a predetermined delay time, wherein a main circuit breaking portion use actuating device and a resistance circuit breaking portion use actuating device are mechanically coupled via a rotatable link so as to provide the predetermined delay time. For mechanically coupling both actuating devices at one end of the drive piston 11*a* for the main circuit breaking portion use actuating device, a conversion lever 15 which converts the linear movement of the piston 11*a* into a rotating movement is attached, and the converted rotating movement is transmitted via a rod 16, a lever 19, a rotatable link 21 and a cam 22 to a hook mechanism for the resistance circuit breaking portion use actuating device to drive the same. The details of the hook mechanism is explained with reference to FIG. 6.

Figure 6:
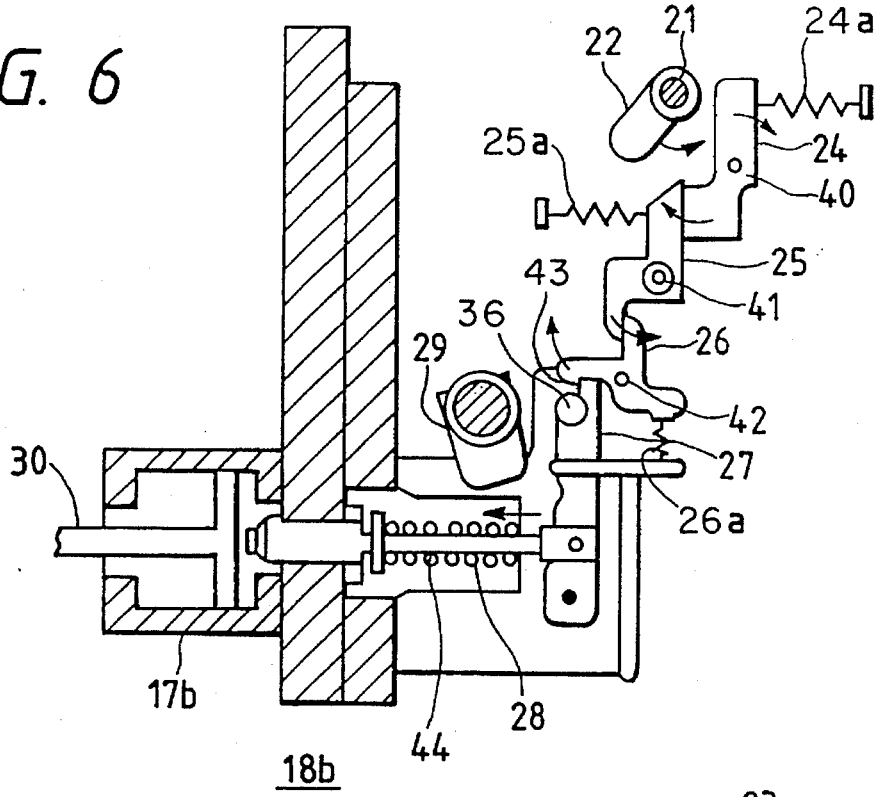
FIG. 6 is a partially cross sectioned side view of a pilot valve control mechanism for the resistance circuit breaking portion, illustrating a delay operation mechanism actuated by a mechanical command signal for the pilot valve control mechanism, of an embodiment of the gas circuit breakers with a resistance circuit breaking portion according to the present invention.

FIG. 6 shows a control mechanism including the hook mechanism for the resistance circuit breaking portion actuating device 14*b*, which controls the actuating fluid from the actuating fluid reservoir. Hereinbelow, the tripping operation starting from the control mechanism to the resistance circuit breaking contact is explained. When the cam 22 rotates in the direction of the arrows shown in FIG. 5, the cam 22 illustrated in FIG. 6 rotates counterclockwise and a lever 24 rotates clockwise around the axis of a pin 40. Successively, a lever 25 rotates around the axis of a pin 41 the counterclockwise direction, and a hook 26 rotates clockwise around the axis of a pin 42. Thus, the hook 27 is released. from the coupled condition at a coupling portion 43, is driven to the left by the spring force of a spring 44, and pushes a rod 28 to the left. As a result, a piston 30 in the pilot valve 17*b* is pushed to the left, and the actuating fluid is permitted to flow into the pilot valve 17*b* and the main control valve 20*b* to drive the piston 11*b* in the direction illustrated by an arrow in FIG. 2 and FIG. 5. Reference numeral 29 a reset cam, which resets the hook 27 by contacting a projecting roller 36.

The above mechanical coupling is highly reliable with respect to electrical noise and the like, and is simple in structure. Further, 1:1 physical coupling of the actuating piston 11*a* for the main circuit breaking portion driving use actuating device 14*a* with the cam link 21 for actuating the pilot valve 17*b* for the resistance circuit breaking portion is made easy, and the delay time setting and adjustment is also achieved very simply. For a circuit breaker that is required to be highly reliable, in particular in the case of a circuit breaker provided with a parallel resistor body for resistance circuit breaking according to the present invention, the characteristic, durability and reliability of the resistor body is greatly affected by the amount of electrical energy flowing through the resistor body. Therefore, a hook mechanism having an even higher reliability is required.

Figure 7:
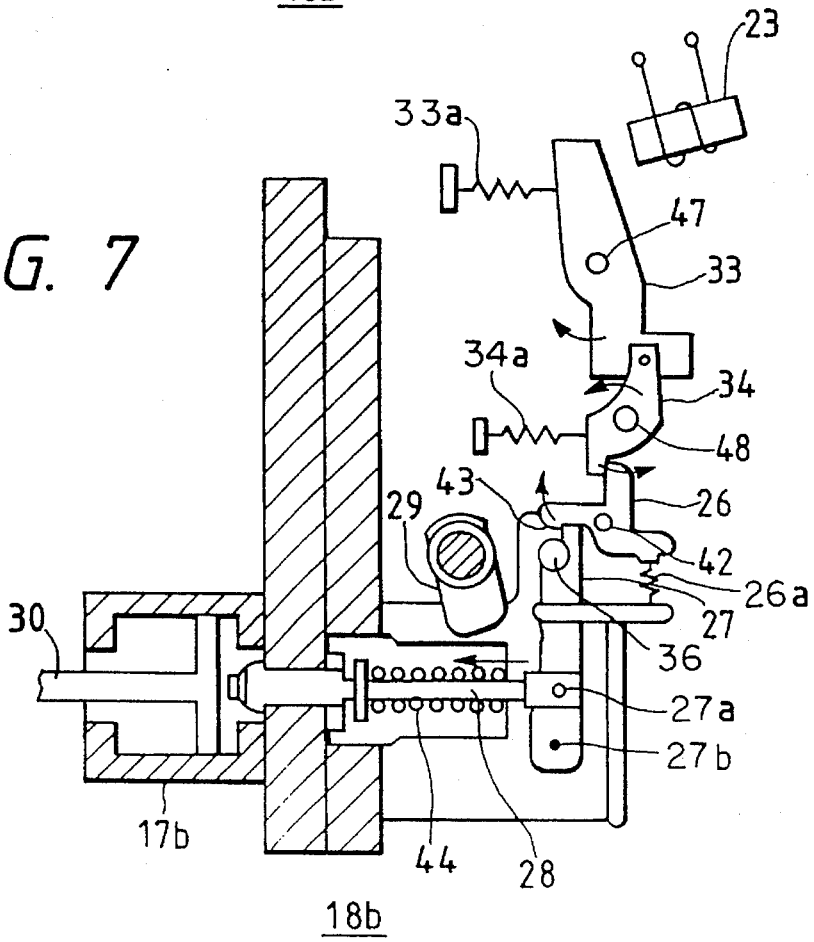
FIG. 7 is a partially cross sectioned side view of a pilot valve control mechanism for the resistance circuit breaking portion, illustrating a delay operation mechanism actuated by an electrical command signal for the pilot valve control mechanism, of an embodiment of the gas circuit breakers with a resistance circuit breaking portion according to the present invention.

In order to realize the predetermined delay time in a highly reliable manner, a measure is employed in which the operation of the main circuit breaking portion is electrically associated with the control mechanism 18*b* for the resistance circuit breaking portion use actuating device 14*b* to drive the same. An example of the mechanism which realizes the above operation is shown in FIG. 7. Other than the use of an electromagnetic coil 23 as an actuating source for the hook 26, the mechanism is substantially the same as the one down in FIG. 6. In response to a tripping signal for the main circuit breaking portion use contact, the electromagnetic coil 23 for the control mechanism 18*b* in the resistance circuit breaking portion use actuating device 14*b* is excited and the lever 33 is rotated around the axis of a pin 47. Thereafter, the mechanism operates in like manner as explained in connection with FIG. 6: the hook 27 is released from the coupling condition, is driven to the left by the spring force of the spring 44, and pushes the rod 28 to the left, whereby the piston 30 in the pilot valve 17*b* is driven to the left. Reference numeral 34 indicates a lever and 48 a pin around which the lever 34 rotates.

Figure 8:
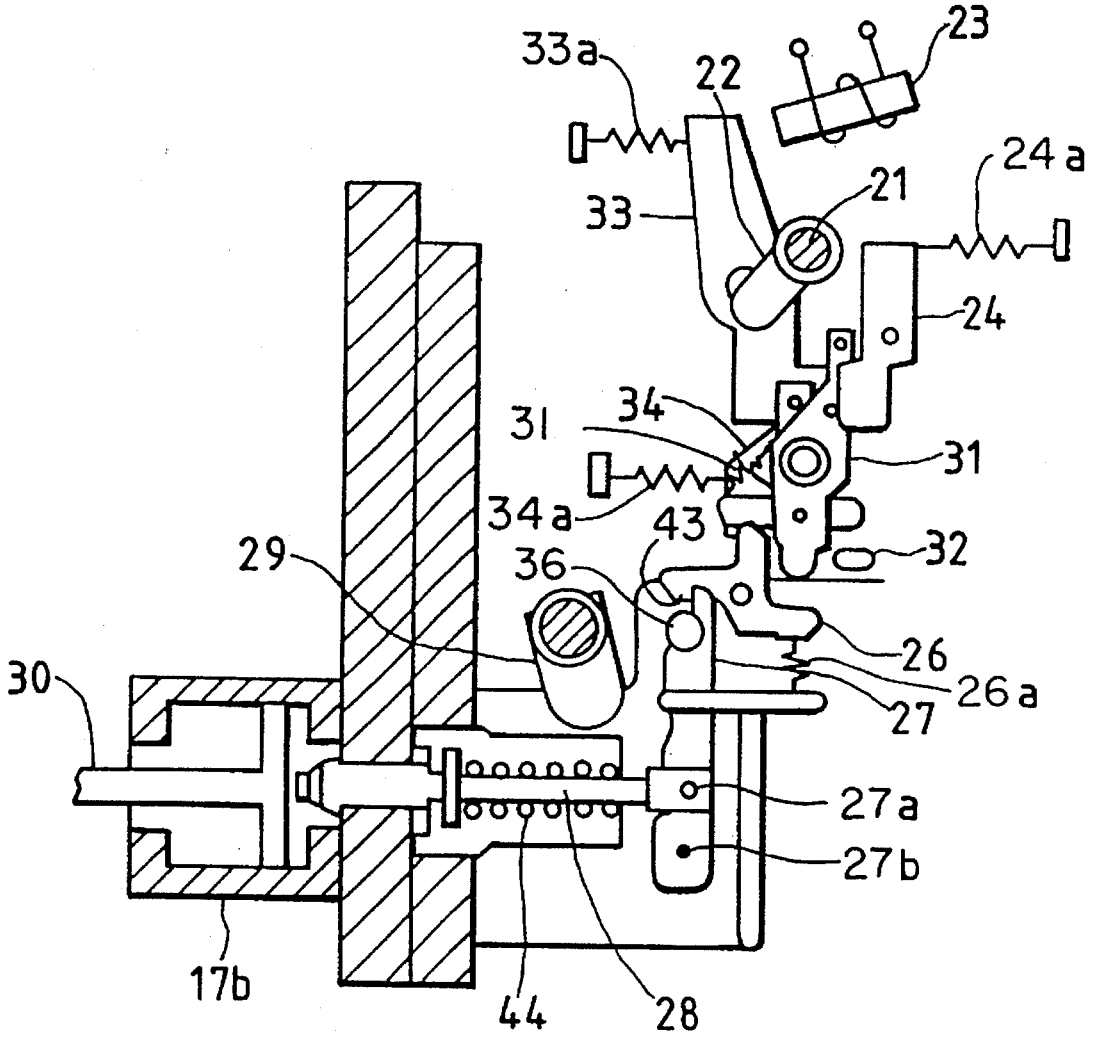
FIG. 8 is a partially cross sectioned side view of a pilot valve control mechanism for the resistance circuit breaking portion, illustrating both a delay operation mechanism actuated by a mechanical command signal, and another delay operation mechanism actuated by an electrical command signal as redundancy for the pilot valve control mechanism, of an embodiment of the gas circuit breakers with a resistance circuit breaking portion according to the present invention.

In the present embodiment, the mechanically commanded pilot valve driving mechanism as illustrated in FIG. 6 and the electrically commanded pilot valve driving mechanism as illustrated in FIG. 7 are provided in parallel as illustrated in FIG. 8. Reference numeral 31 designates a lever for maintaining the circuit breaking position and 32 a stopper both of which replace the lever 25 of FIG. 6. Through the provision of the mechanically commanded delay operation mechanism and the electrically commanded delay operation mechanism as a redundancy, for example, when the rotatable link 21 as illustrated in FIG. 5 is broken, the control by the resistance breaking portion actuating mechanism 14*b* cannot be engaged by the driving force from the driving piston 11*a* for the main circuit breaking portion actuating mechanism 14*a* during the tripping operation of the circuit breaker. However through the electrical command, the electromagnetic coil 23 is excited, and the hook mechanism 18*b* for the resistance circuit performs the tripping operation. As a result, the resistance circuit breaking use contacts 2*a*, 2*b* are interrupted. Accordingly, the potential break-down of the resistor bodies 3*a*, 3*b* due to uninterruted current flow is prevented.

In the present embodiment, since the electrically commanded delay operation is used as a back-up for the mechanically commanded delay operation, the electrically commanded delay operation is set to operate slightly later than the mechanically commanded delay operation. However the operation timing of the electrically commanded delay operation can be set simmultaneously with or prior to the mechanically commanded delay operation.

In the present invention, since the tripping mechanism employing the electromagnetic coil is provided for the resistance circuit breaking portion driving use actuating device 146, even when the main circuit breaking portion actuating mechanism 14*a* malfunctions and is inoperable, and only the resistance circuit breaking use contacts 2*a*, 2*b* made during a making operation of the circuit breaker, such a malfunction is detected by monitoring auxiliary contacts, for example. In response to the detection, the electromagnetic coil 23 is excited by an electrical command and the hook mechanism 18*b* in the resistance circuit breaking portion actuating mechanism 14*b* performs the tripping operation, whereby the resistance circuit breaking use contacts 2*a*, 2*b* are interrupted. Accordingly, the potential break-down of the resistor bodies 3*a*, 3*b* due to uninterruted current flow is prevented.

According to the present invention which has been explained above, through the provision of the mechanically commanded delay operation mechanism and the electrically commanded delay operation mechanism as a redundancy, the coil provided for tripping the resistance circuit breaking portion is excited via an electrical delay circuit in response to a tripping signal for the main circuit contact, and the operation of the resistance circuit breaking portion is reliably performed, whereby thermal break-down of the resistor body and other problems are prevented. Further, even when a making operation malfunctions because the main contact is inoperable and maintains an interrupted condition, and only the resistance contact connected in parallel with the main contact is made, the electrically commanded delay operation mechanism excites the coil and immediately trips the resistance circuit breaking portion to ensure the tripping operation of the resistance contact. With the redundant operation of both the mechanically commanded and the electrically commanded delay operation mechanisms, the gas insulated switch gear device according to the present invention reduces the danger of such problems as thermal break-down of the resistor body and improves the reliability of the switch gear device.

We claim:

1. A gas circuit breaker having a resistance circuit breaking portion connected in parallel with a main circuit breaking portion, comprising:

a main circuit breaking portion actuating mechanism; and a resistance circuit breaking portion actuating mechanism;

wherein said resistance circuit breaking portion actuating mechanism includes a first delaying mechanism mechanically coupled to said main circuit breaking portion actuating mechanism, and a second delaying mechanism independent from said first delaying mechanism and operated in response to an electrical command signal generated according to one of a first interrupting electrical signal for activating said main circuit breaking portion actuating mechanism, and a second interrupting electrical signal independent of said first interrupting electrical signal and generated when said main circuit breaking portion actuating mechanism malfunctions; and wherein said main circuit breaking portion actuating mechanism and said resistance circuit breaking portion actuating mechanism are encased in a casing located at a grounding potential side.

2. A gas circuit breaker according to claim 1, wherein a delay time introduced by said first delaying mechanism is shorter than a delay time introduced by said second delaying mechanism.

3. A gas circuit breaker, comprising:

a main circuit breaking portion including a first movable contact electrode and a first stationary contact electrode;

a resistance circuit breaking portion connected in parallel with said main circuit breaking portion, said resistance circuit breaking portion including a series connection of a resistor body, and a second movable contact electrode, and a second stationary contact electrode;

an actuating mechanism for the respective movable contact electrodes, accommodated in a casing located at a grounding potential side, said actuating mechanism including a main circuit breaking portion actuating mechanism having a first actuating piston and a resistance circuit breaking portion actuating mechanism having a second actuating piston; and respective rod and link mechanisms operatively coupling the respective actuating pistons in said main and resistance circuit breaking portion actuating mechanisms with the respective movable contact electrodes;

wherein said resistance circuit breaking portion actuating mechanism further includes a main control valve for controlling flow of a pressure medium to and from said second actuating piston in said resistance circuit breaking portion actuating mechanism, a pilot valve for controlling flow of said pressure medium to and from said main control valve, and a control mechanism for actuating said pilot valve; and wherein said control mechanism includes a first tripping mechanism which is mechanically coupled to said first actuating piston in said main circuit breaking portion actuating mechanism via a mechanical delay means and which is mechanically triggered by the actuation of said first actuating piston in said main circuit breaking portion actuating mechanism with a first predetermined time delay determined by said mechanical delay means, a second tripping mechanism which is electrically coupled to an interruption command electrical signal for activating said main circuit breaking portion actuating mechanism via an electrical delay means and which is electrically triggered by the interruption command electrical signal with a second predetermined time delay determined by said electrical delay means, and a hook mechanism which controls said pilot valve and which is unlatched by both said first tripping mechanism and said second tripping mechanism.

4. A gas circuit breaker according to claim 3, wherein the first predetermined delay time is shorter than the second predetermined delay time.

5. A gas circuit breaker according to claim 3, wherein said second tripping mechanism is further triggered by an electrical command signal which is generated when only said resistance circuit breaking portion is closed in response to a close command electrical signal for said main circuit breaking portion.

* * * * *